US006118104A

United States Patent [19]

Berkcan et al.

[11] Patent Number: 6,118,104

[45] Date of Patent: Sep. 12, 2000

[54] METHOD AND APPARATUS FOR BOIL STATE DETECTION BASED ON ACOUSTIC SIGNAL FEATURES

[75] Inventors: Ertugrul Berkcan, Niskayuna; Pierino Gianni Bonanni, Clifton Park; Vivek Venugopal Badami, Schenectady; Emilie Thorbjorg Saulnier, Rexford, all of N.Y.

[73] Assignee: General Electric Company, Schenectady, N.Y.

[21] Appl. No.: 09/273,065

[22] Filed: Mar. 19, 1999

[51] Int. Cl.[7] ..... H05B 1/02

[52] U.S. Cl. ..... 219/494; 219/481; 219/501; 219/497; 374/102; 73/587; 73/590; 99/330

[58] Field of Search ..... 219/494, 497, 219/501, 508, 481, 441, 442; 340/540, 603, 526; 73/587, 584, 590; 99/331, 330; 374/102, 105

[56] References Cited

U.S. PATENT DOCUMENTS

| | | | |
|---|---|---|---|
| 2,757,869 | 8/1956 | Ray . | |
| 4,140,021 | 2/1979 | Nomura et al. | 73/587 |
| 4,493,980 | 1/1985 | Payne et al. . | |
| 4,740,664 | 4/1988 | Payne et al. | 219/449 |
| 4,869,233 | 9/1989 | Stulen et al. | 126/351 |
| 4,952,766 | 8/1990 | McDonald | 219/506 |
| 4,962,299 | 10/1990 | Duborper et al. . | |
| 5,067,474 | 11/1991 | Chi . | |
| 5,101,774 | 4/1992 | Marziale et al. | 122/504.2 |

FOREIGN PATENT DOCUMENTS

| | | |
|---|---|---|
| 806 887 | 11/1997 | European Pat. Off. . |
| 196 38 355 | 9/1996 | Germany . |
| 2143053 | 1/1985 | United Kingdom . |

*Primary Examiner*—Mark Paschall
*Attorney, Agent, or Firm*—John F. Thompson; Jill M. Breedlove

[57] ABSTRACT

The present invention provides a method of determining the boil states of a liquid as measured by an acoustic sensor which measures the acoustic signal generated by the liquid as it is heated. The acoustic signal is smoothed and a first derivative of the acoustic signal is calculated. Also the frequency of the acoustic signal is measured. Derivative inflection points, zero slope points, and acoustic signal frequencies are utilized to determine the pre-simmer, simmer, pre-boil, boil, boil dry, and boil over states of the liquid.

27 Claims, 11 Drawing Sheets

300

METHOD AND APPARATUS FOR BOIL STATE DETECTION BASED ON ACOUSTIC SIGNAL FEATURES

BACKGROUND OF THE INVENTION

The invention relates to a method for determining boil states of the contents of cooking utensils on range cook-tops. More specifically, the invention relates to a method for determining boil states using an acoustic sensor system.

Boiling water or other fluids or foods (generically "liquids") is one of the most common uses for a range. It is typically desirable to closely monitor the boil phase of the liquid during such processes, i.e., to identify the pre-simmer, simmer onset, simmer and/or boil phases. In this regard, the pre-simmer phase is generally characterized by a calm liquid and the simmer onset phase is the initial, slow bubbling of the liquid characterized by the appearance of individual bubbles. During the simmer phase, bubbles appear in jets creating the effect commonly referred to as simmering. Finally, in the boil phase, the bubbling of the liquid is generalized, resulting in the familiar turbulence of a boiling liquid. These phases can be identified by experts and experienced cooks. The formation and collapse of the bubbles during the phases create an acoustic signature which changes with the size and number of the bubbles, the rate of their formation, their collapse, and the temperature gradient in the liquid. This acoustic response includes the audible component, which can be easily observed when cooking, as well as responses in various frequency bands. It is also affected by factors including the type of cooking vessel and any ingredients in the liquid.

The boil phase is monitored for a number of reasons. First, many cooking processes require that the liquid be attended to upon identification of a particular boil phase, e.g., stirring or adding ingredients. In addition, the boil phase may be monitored to reduce heat after the liquid reaches a boil, either to reduce it to a simmer for cooking purposes or so as to prevent boil-over. Boil-over can result in a burned-on mess or, in the case of gas ranges, extermination of the cooking flame. Moreover, a liquid not monitored upon boiling can boil dry, resulting in burning of the food, damage to cooking utensils, or potentially a fire or other safety hazard.

Conventionally, the boil phase is monitored visually. Such visual monitoring can interfere with the user's ability to prepare other foods or be otherwise fully productively disposed during heating of the liquid. Moreover, a busy or inexperienced cook may fail to accurately and in a timely manner identify a boil phase of interest.

Increasingly, in the market for household appliances, manufacturers seek to provide, and consumers desire to have, appliances with a greater degree of automated operation and control. With the increasing affordability of integrating computing power into an appliance, there exists a potential to provide the increased levels of automated control. However, the information gathering tools or devices that will interact with a computer or processor in monitoring or controlling the operation of the appliance must also have desirable cost/performance attributes.

For cooking appliances generally, and for electric, inductive, and gas range cook-tops specifically, automation or partial automation of control of the cooking process, or monitoring of cooking on a cook-top, has traditionally focused on temperature monitoring or sensing. Various temperature sensors have been proposed for sensing the temperature of a surface heating unit or a cooking utensil positioned thereon, and for controlling the heat input to the heating unit, based upon the sensed temperature. Such sensors have commonly been proposed for use in connection with glass-ceramic radiant cook-tops. Another form of temperature based sensing is a direct food probe which is inserted into the liquid to measure temperature directly.

Temperature-based sensing systems for ranges or cook-tops may indirectly or inferentially provide information regarding a boil state of a liquid contained in a utensil and being heated on the cook-top. However it continues to be a problem in cook-top sensing and control to provide a method for reliably determining the boil state since the correlation between temperature and boil state depends on a number of variables including, but not limited to, type of liquid, the amount of liquid, any additives, the position of the utensil, and the utensil's warpage. For instance it is well known that the addition of salt into water raises the boiling temperature. Environmental conditions such as elevation can also affect the temperature associated with boil states. Finally, the position of the temperature sensor and its calibration can also have a significant impact on achievable accuracy. The general need then is to develop an approach to boil state determination that is more robust to cooking modalities, vessels used, various user interactions, and other variations or disturbances in the equipment or environment.

BRIEF DESCRIPTION OF THE INVENTION

It has been determined in the development of the present invention that the various phases of boiling have distinctive acoustic signatures, and that the acoustic signatures are repeatable and robust to many commonly occurring disturbances. Further, it has been determined that the shape and other characteristics of the complete profile of acoustic signatures is obtained when cooking conditions, such as varying liquid levels or load sizes, are changed or some common disturbances occur such as stirring, eggs boiling, or frequent lifting of the pans. The method employed in this invention is the use of a feature recognition algorithm to identify these unique characteristics so as to determine boil states of a heated liquid. The method thus provides a reliable way of determining the boil states, including, but not limited to, simmer onset, boil, boil over and boil dry states, for the contents of a cooking utensil on a range cook-top. This is achieved by taking advantage of the consistent, repeatable, and distinctive acoustic signatures of liquid in various cooking utensils at various boil states, sensing those signatures with one or more acoustic sensors, and processing the output of the acoustic sensor or sensors as desired to efficiently control the cooking process.

The present invention provides a method of determining the boil states of a liquid as measured by an acoustic sensor system which measures the acoustic signal generated by the liquid as it is heated. The sensor system may itself include a filter, an amplifier, and initial signal processing of the acoustic signal, such as calculation of its average power.

In one embodiment, the feature recognition algorithm employs signal smoothing techniques various order derivatives to detect characteristic changes in the slope of the signal, for instance inflection points. Specifically, the following steps are employed to identify the various boil states of the liquid. Step one, smooth the acoustic signal. Step two, generate a first derivative of the acoustic signal, and smooth it as needed. Step three, determine a first zero slope point and a second zero slope point from the acoustic signal. Step four, determine a zero slope point from the first derivative at the positive and negative peaks. Step five, determining a positive going inflection point and a negative going inflection point of the acoustic signal from the first derivative. Finally, step six, identify the boil phases of the heated liquid using the inflection points, the zero slope points, and the acoustic signal frequencies as these points arise in the signal and are identified.

DETAILED DESCRIPTION OF THE INVENTION

It has been determined that a characteristic response created by heated and boiling liquid may be obtained by using an acoustic sensor. An acoustic sensor system is employed, which includes, at least one acoustic sensor to enable the sensor to detect or acquire an acoustic emission signature 100 of the utensil and contents positioned on the cook-top, such emission signature being illustrated in FIG. 1. Various phases of boiling may be detected acoustically, as the acoustic signatures of the phases are also distinctive and repeatable. The phases may be identified by names which characterize the action of the boiling liquid. The term "convection" may be used to describe the pre-simmer phase in which the initial heating of the liquid from ambient to a temperature approaching the boiling point occurs. The simmer onset phase is the state in which the first signs of coalescence or nucleation of gases dissolved in the liquid and gases produced by the heating appear at sites within the cooking utensil, for example, at surface irregularities along the bottom and side walls of the cooking utensil, and such gas bubbles begin to travel towards the surface of the liquid to escape. These bubbles, typically, collapse before reaching the surface due to the temperature gradient in the liquid, and lead to a characteristic sound. "Jet" nucleation occurs in the simmer phase, in which gas bubbles are formed more frequently and are of larger size, which bubbles also more rapidly rise to the upper surface of the liquid and escape along columns. The boil phase may also be termed a "rolling boil" phase, at which stage the liquid is highly agitated, and turbulent, by the increased number of gas bubbles formed and escaping out of the liquid.

Figure 3:
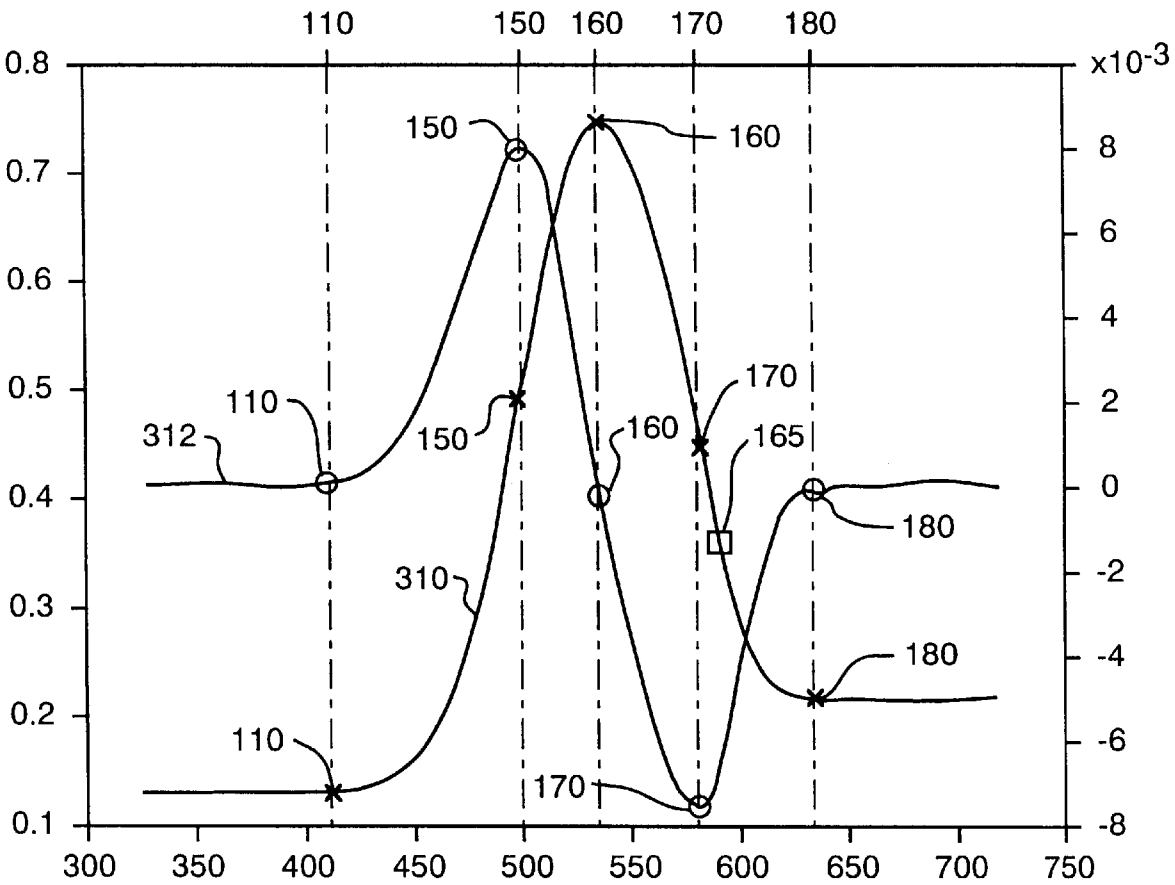
FIG. 3 is a graph of a smoothed first and second derivative plot of the acoustic signal.

One illustrative example of a characteristic feature set of the acoustic signal that is useful in the boil state determination process includes the following points, identified in FIG. 3:

110—Point of Leaving Lower Plateau

150—First Inflection Point (transition to pre-simmer)

160—Maximum (simmer)

170—Second Inflection Point (pre-boil boil onset)

165—Threshold point which correspond to the onset of rolling boil

180—Rolling Boil Plateau (steady state boil)

FIG. 3 provides a graphical illustration of a filtered acoustic signal 310 and a first derivative 312 of filtered acoustic signal 310. Because filtered acoustic signal 310 and first derivative 312 together present distinguishable data points for the feature set of interest, filtered acoustic signal 310 and first derivative 312 enable the identification of various stages of the boil phases. In addition, the second derivative (not shown) can be used to enable this identification.

The acoustic signal 140 and derivatives 312 (while the $2^{nd}$ derivative is not show) need not be the only features defined or taken into consideration by a cook-top controller in determining the boil phase, or in controlling the cooking cycle. Heuristic or empirically based features may also be defined, which belong to the characteristic feature set to be used for controlling the cooking cycle. This may advantageously be done to better correlate the temperature of the food being cooked in the liquid to acoustic signal 140, and the filtered acoustic signal 310, as further described below.

Ordinarily a specific point of interest to the cook-top controller is the second inflection point 170 (FIG. 3), which essentially signifies that a rolling boil onset state has been achieved. A further example of using the acoustic signature and its first order derivative, and also factoring in an empirically-based feature, may be to select a different point, which more closely correlates to the temperature of the food being cooked in the boiling liquid. The point 165 is an intermediate point representing a weighted average of the amplitudes of the signal at points 110 and 160. Food temperature based on point 165 may more clearly correlate to a desired cook state of the food. The weighting of point 165 is based on correlation with food temperature and the desired phases through experimentation or other techniques based on user preference. One exemplary weighting of point 165 is calculated according to the following equation: point 165 value=(point 110 value * (x)+point 160 value * (1−x))/(point 110 value+point 160 value), where "x" is a number between about 0.30 to about 0.4.

Figure 2:
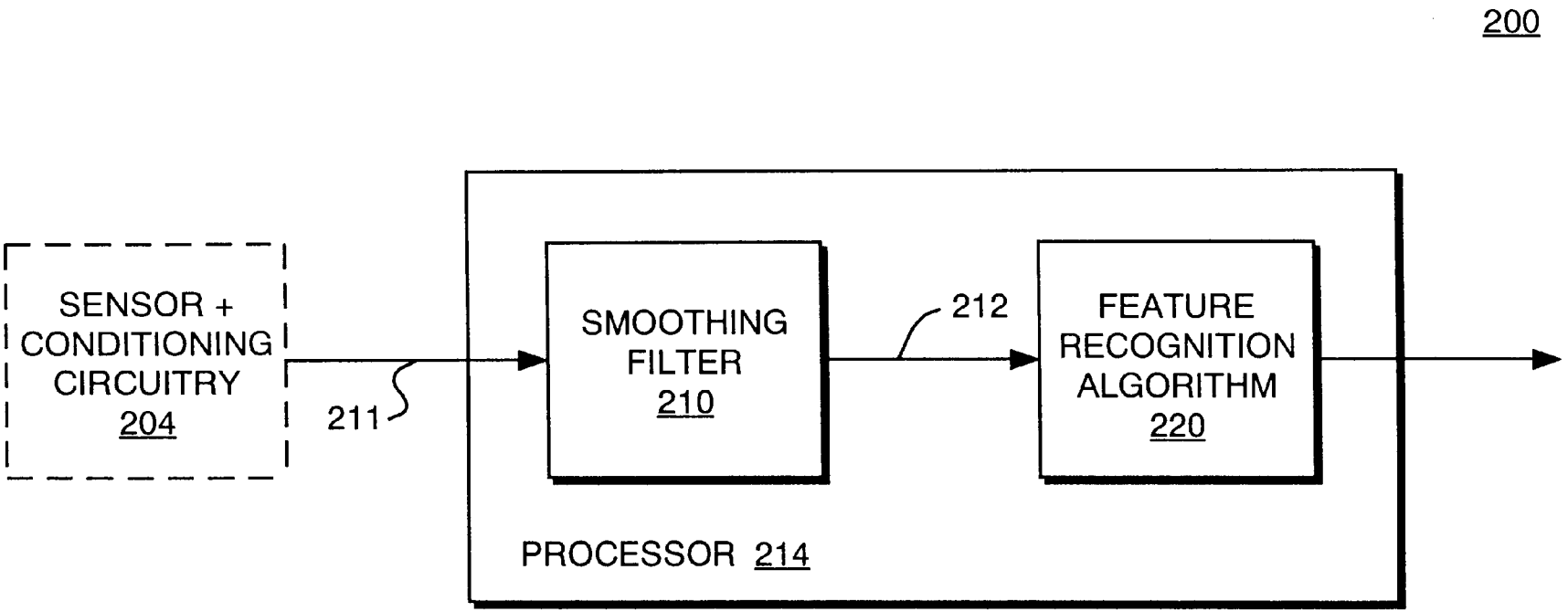
FIG. 2 is a functional block diagram of a processor employing a low pass filter and a feature recognition algorithm of the present invention.

An acoustic sensor system 200, as illustrated in FIG. 2, is used to detect boil states of various liquids. Sensor system 200 comprises an acoustic sensor having conditioning circuitry 204 which is coupled to a processor 214. Processor 214 comprises smoothing filter such as a low pass and averaging filter 210, and a feature recognition algorithm 220. Low pass and averaging filter 210 is preferably selected or set to provide the best or preferred averaged acoustic signal. The particular filtering method selected may be tailored to fine tune the performance of a particular sensor for a particular cook-top or other cooking modality. The acoustic signal filtering method is further utilized to exclude or filter out sources of interference or potential interference, such as ambient acoustic emissions or noise. Various types of acoustic sensors presently available on the market are believed to be well suited for use in sensor system 200. Suitable acoustic sensors 204 that may be used as part of system 200 include microphones, piezoelectric vibration/acceleration sensors, and semiconductor acceleration sensors. In addition, an accelerometer of the type known in the art as a micro-electro-mechanical system, or MEMS, would be suitable for use.

A processor 214 receives and processes the acoustic signal provided by the sensor system 204. Processor 214 is desirably programmed with feature recognition algorithm 220 to interpret the signal as corresponding to a particular boil state or boil characteristic, as, for example, by generating and evaluating the signal and a set of derivatives of the acoustic signature pattern, illustrated in FIG. 3. Processor 214 is also preferably provided with a set of instructions by which an output from the processor will be generated, as further described below. The smoothing component can be used more than once to obtain a smoothing of the signal as well as the derivatives of the signal.

Sensor system 200 (FIG. 2) generates at least one boil state signal that may be employed to automatically control a heat source coupled to the cook-top. In this Specification the heat source described is representative of any apparatus used to heat the contents of a utensil, including, but not limited to electric, inductive, microwave, and gas cooking devices. For example, sensor system 200 may automatically control a heating coil to sustain a rolling boil or simmer for a predetermined period of time, or indefinitely, and may also be programmed to reduce the temperature of the heating coil when the system determines, based upon acoustic signal 140, that certain feature or condition has been encountered, including, point of leaving lower plateau, pre-simmer, simmer, boil-onset, weighted average rolling boil, rolling boil, boil over, and boil dry conditions. Additionally, sensor system 200 may actuate an indicator, such as an audible indicator or visual indicator, to indicate to the operator that a predetermined desired, or undesirable, boil state has been reached.

A preferred method of processing of the acoustic emission signal in determining a boil state in order to automatically control the cooking process, or to activate an indicator, involves filtering of the signal and calculating first-order derivative. This enables the determination or recognition of inflection points, maximum values or other intermediate points such as 165 which are useful in more accurately correlating the acoustic emission data to the boil phases of interest.

Obtaining first, and alternatively, higher order derivatives of the filtered acoustic signal can be useful in more accurately determining or characterizing the boil state of a liquid, or other boil events such as boil over and boil dry conditions. This is possible because the acoustic signature of a boil cycle, as filtered and processed to produce an acoustic response, as discussed previously, has various characteristic features which can be identified in the signal and at least one filtered derivative.

Figure 6:
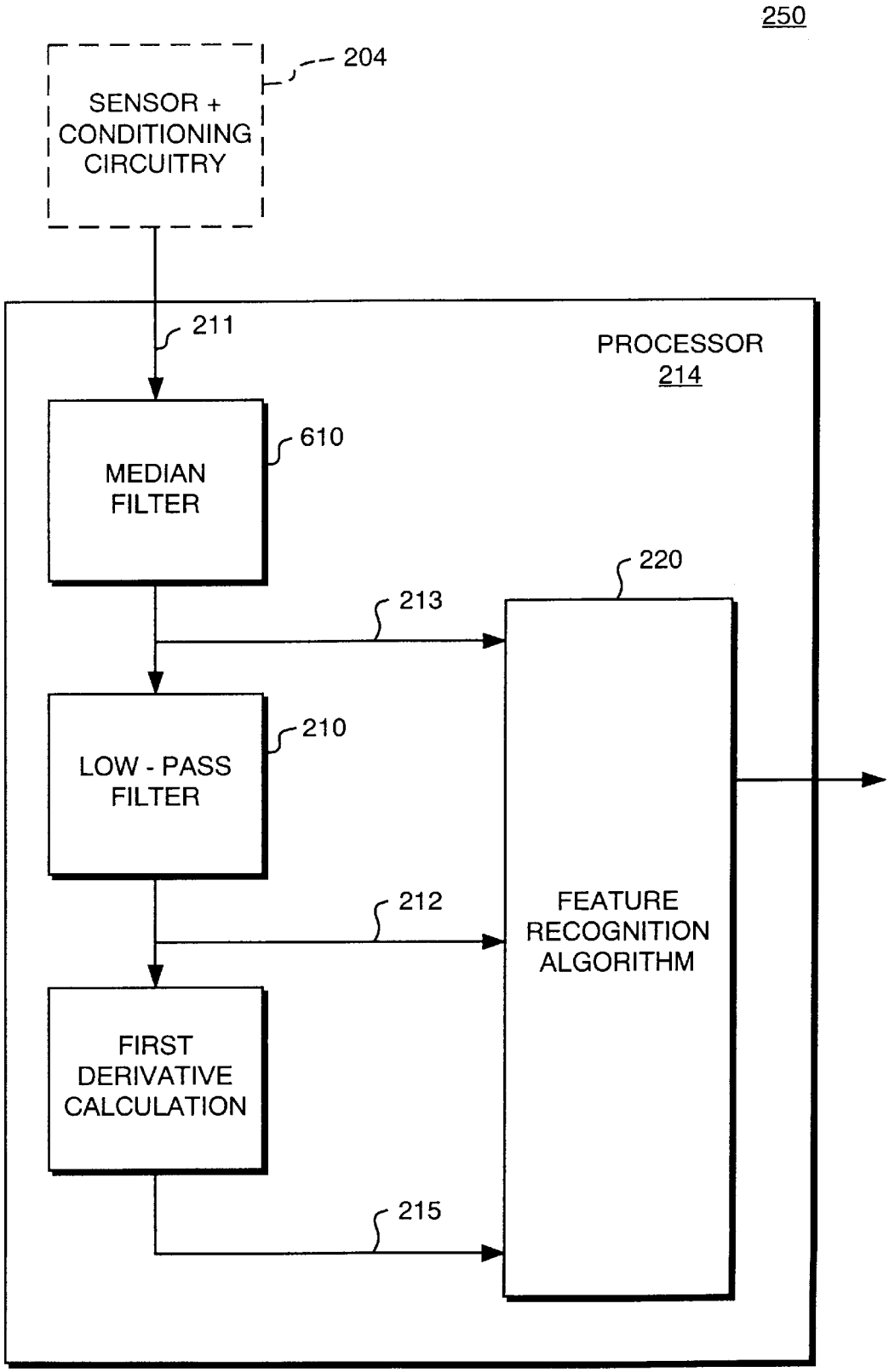
FIG. 6 is a functional block diagram of the acoustic sensor circuit of the present invention employing a median filter.

A filter that discriminates against outlying or atypical data points such as a median filter may be used in addition to or prior to low pass and averaging filter 210 identified above, to minimize outlying data portions of acoustic signal 140 not filtered by filter 210. The median filter is well suited to filter outlying data that is not statistically near the center of the signal data. These outlying data points can be caused by sudden impact type of noises. The median filter may be used to remove outlying data representing signal interference that can occur in acoustic signal 140, such as sudden impacts. One preferred implementation of the median filter uses the sliding window type median filter 610, as illustrated in FIG. 6, wherein, for each position of the sliding window, the $50^{th}$ percentile value of the set of data included in the window is chosen. Generally, a median is a robust estimate of the center of a sample of data. Outlying data has little effect on the median, as such, the median filter acts to smooth the data set.

Another exemplary method for detecting boil states utilizes sensor system 250, illustrated in FIG. 6. This boil state detection method comprises seven steps, wherein boil state detection is preceded by a set of three pre-processing steps, followed by four boil state detection steps, described below.

Step 1. The acoustic signal, graphically illustrated in FIG. 7*a*, generated by sensor and conditioning circuitry 204 (FIG. 2) is coupled to processor 214 by acoustic signal line 212. The acoustic signal is filtered by median filter 610 (FIG. 6) to remove anomalous spikes. Median filter 610 of length "n" is coupled to acoustic signal line 212. Length "n" is defined as the number of sample data values required by median filter 610 to provide the median function. Medial filter 610 generates a respective median filter signal value at each time step which is representative of the statistical median of the most recent "n" acoustic signal values.

Step 2. The median-filtered signal at median filtered signal line 213 is filtered by low-pass filter 210 to remove ripples and to enable robust calculation of first derivative 312. In one exemplary embodiment, low-pass filter 210 is implemented in a manner exactly analogous to median filter in Step 1, where the statistical median over "n" sample acoustic signal values is replaced by the statistical mean of the acoustic signal values.

Figure 7A:
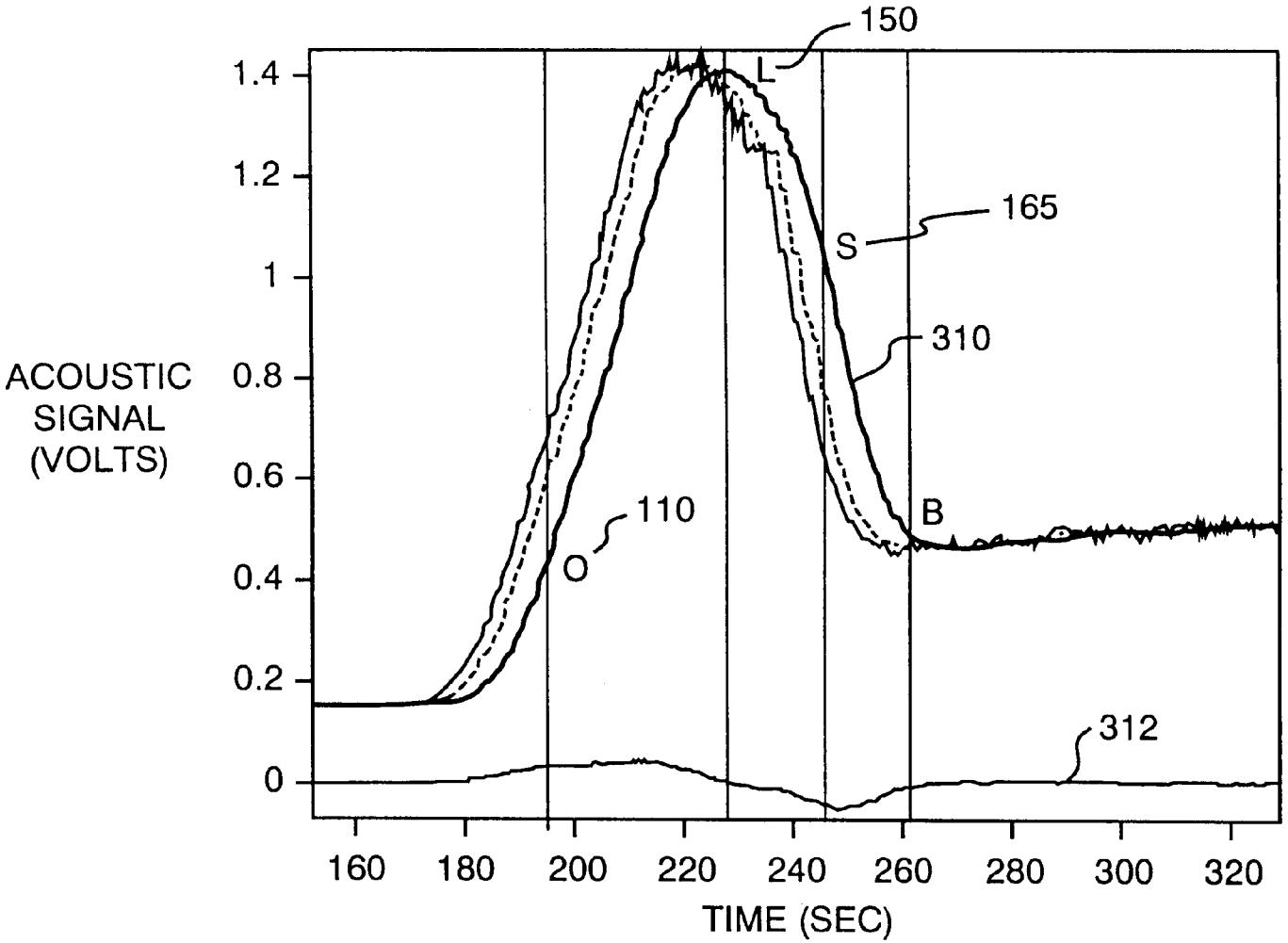
FIGS. 7*a* and 7*b* are graphs of the unprocessed and filtered acoustic signal, its first derivative and the water temperature signal.
Figure 7B:
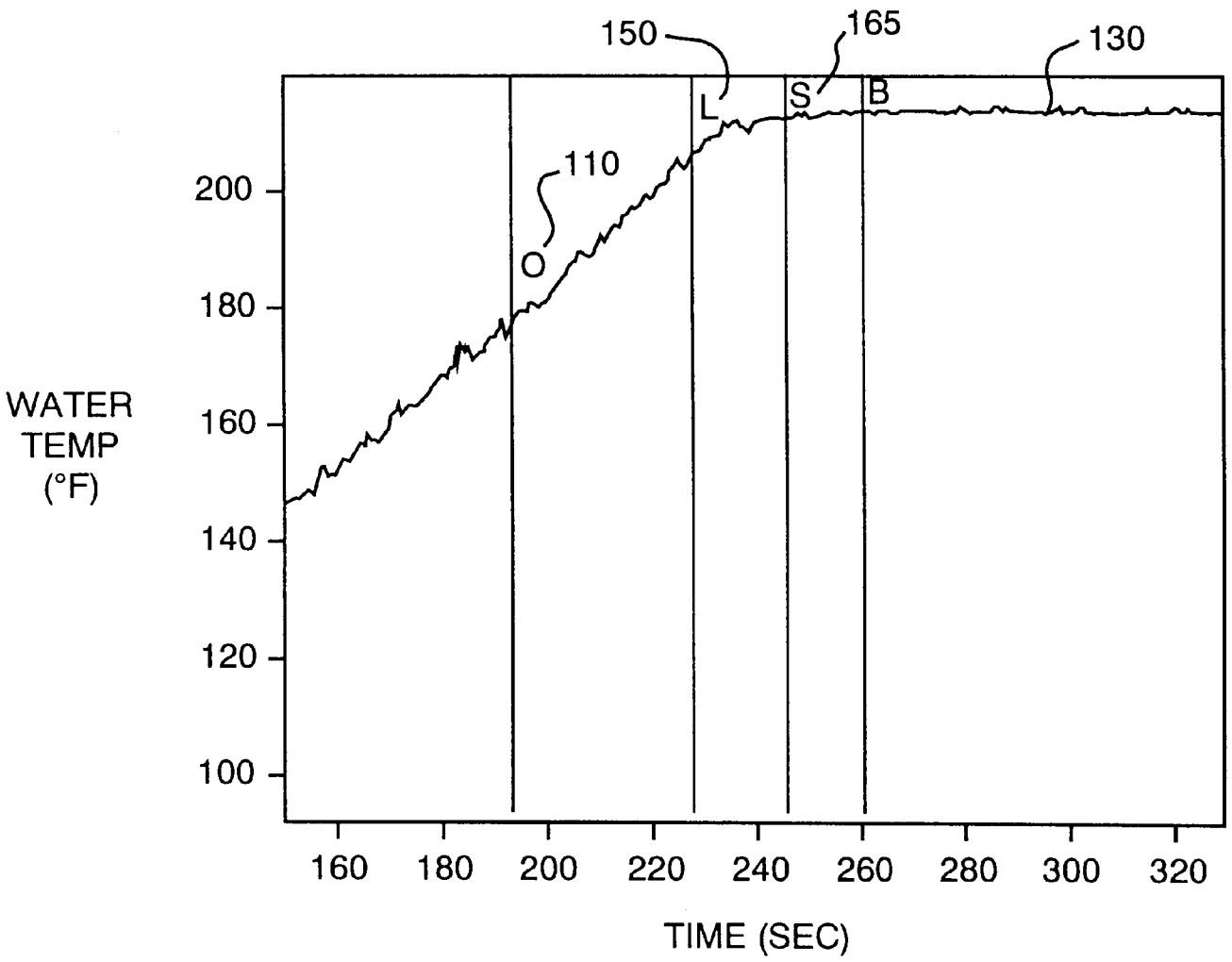

Step 3. The low-pass-filtered signal generated by lowpass filter 210 is used to calculate first derivative signal 312 (FIG. 7*a*). The incremental derivative signal is calculated at each time point by determining the difference between the current and previous value of the low pass filter signal, divided by the duration of the time step between the two readings. Note that this calculation produces a smoothed and delayed first derivative of the acoustic signal 140. The delays appearing in this signal as well as in the outputs generated by step 1 and step 2, when compared to acoustic signal 140, are a consequence of the additional data points needed to calculate a first derivative. The number of points that can be used is a function of the tolerable response delay and should be chosen such that the feature recognition algorithm 220 (FIG. 6) determine the boil state in near real time.

Next, boil phase detection is carried out by a series of feature recognition steps using the data generated by steps 1 through 3.

Step 4. Event 110, (Leaving Lower Plateau) (FIG. 7*a*) which marks the start of the acoustic cycle but precedes the boil states of interest, is identified when median filter signal crosses a positive threshold value. The specific threshold value is not critical, but in one embodiment is typically set to a heuristically determined value that corresponds with about 30% of the previously measured peak value of acoustic signal 310. Event 110 serves as a trigger for successive detection steps; attempting boil state detection before Event 110 occurs would lead to false indications because of the high sensitivity of the first derivative signal, and hence the detection algorithm itself, to the lower signal to noise ratio of the acoustic signal during the quiet early phase of heating.

Step 5. Following Event 110, Event 150 (Pre-simmer) (FIG. 7*a*) is identified by detecting the next instance at which positive going first derivative signal 312 crosses zero. Event 150 is associated with the peaking of the acoustic signal 310 and correlates well with the pre-simmer condition.

Step 6. Following Event 150, Event 165 (Weighted Average Rolling Boil) is found by detecting the succeeding instance at which the low-pass filtered acoustic signal 310 crosses a threshold value that is continuously calculated as a weighted sum of two previously occurring values of this signal: its initial value and its to-date maximum (i.e., its maximum up to and including the current time.) The ratio of the weights in this threshold calculation is regarded as a tuning parameter, but good results have been obtained in water boiling experiments using a 35/65 weighting. Event 165 correlates well with the simmer condition.

Step 7. Following Event 165, Event 170 (Rolling Boil Onset) is identified by detecting the next instance at which first derivative signal 312 crosses a small negative threshold value. There is again some liberty in selecting this threshold value, but good results have been obtained using a continuously calculated value of 20% of the minimum value of first derivative signal 312. Event 170 is associated with the leveling off of acoustic signal 310.

Figure 4:
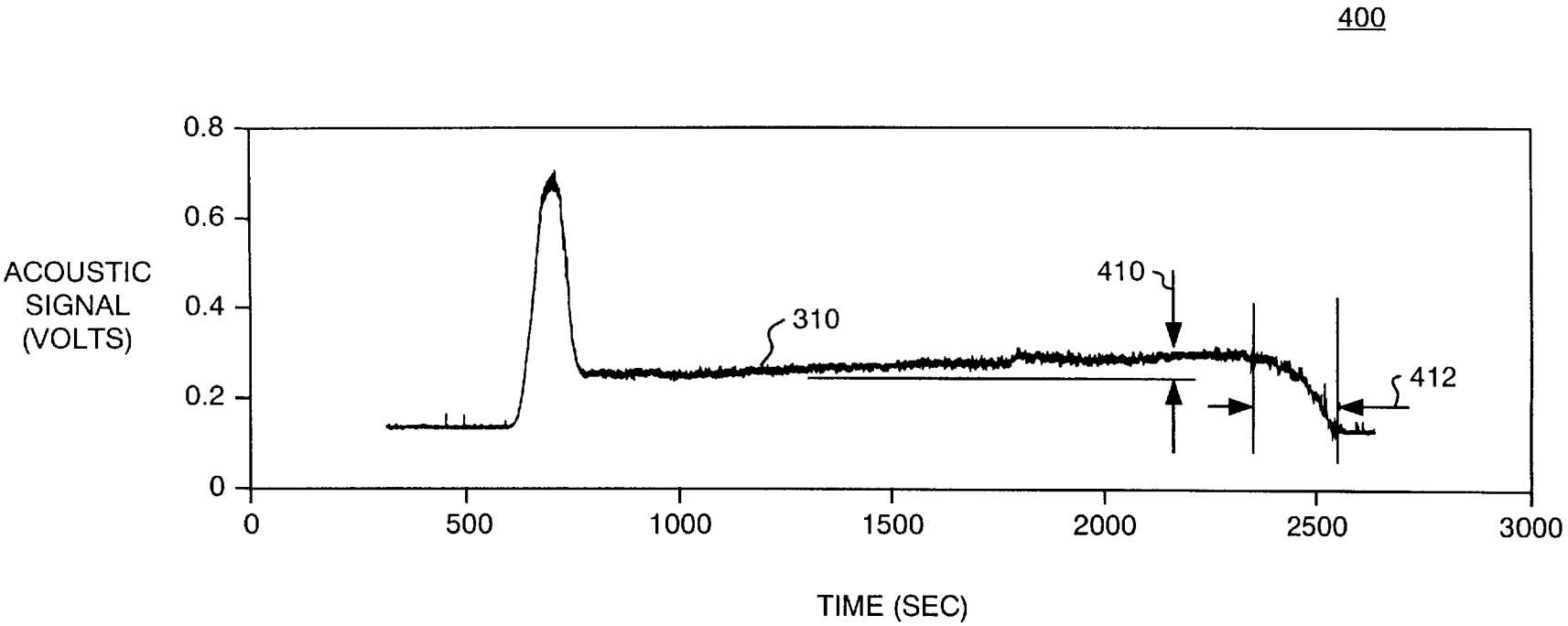
FIG. 4 is a graph of the acoustic signal before, during a boil and during a boil dry condition.

A boil dry state is the condition when the liquid contents of the heated utensil evaporates during the boil phase. This boil dry condition generates a unique acoustic characteristic waveform 400, as illustrated in FIG. 4, where, in one example, filtered acoustic signal 310, measured in volts, is plotted over a time interval of about 2600 seconds. The boil dry condition becomes evident in the interval between about 2333 seconds and about 2600 seconds. This boil dry condition, typically, occurs after rolling boil phase 180 has been achieved. As such, the boil dry condition is evidenced by a gradual decrease in the acoustic signal 310 rather than a sudden change in the signal. In addition, the derivative of the signal 310 is also indicative of the boil dry condition, such as a gradual decrease rather then a sudden decrease in the rate of change or derivative of acoustic signal 310 after rolling boil state 180 is achieved. By way of example and not limitation, the rate of change illustrative of a boil dry condition 412 may be identified as 50% magnitude reduction in filtered acoustic signal 310 over a 200 second time interval, after rolling boil state 180 is achieved. Additionally, the magnitude of acoustic signal 310 may increase by about 10% as the liquid boils off, before the boil dry condition is reached, as depicted by a boil dry temperature rise range 410.

Another exemplary calculation of the boil dry condition is presented next. The boil dry condition is associated with a roll-off of the acoustic signal during the rolling boil phase. The boil dry condition is identified following the rolling boil condition 165 (FIG. 7*a*), by detecting the succeeding instance at which low-pass filtered acoustic signal 310 crosses a small positive threshold value. This boil dry threshold value is calculated as a percentage of the "plateau" value observed during the rolling boil phase 165. Once again, the precise percentage is not critical, but a 10% value has yielded useful results in water boiling experiments.

Figure 5:
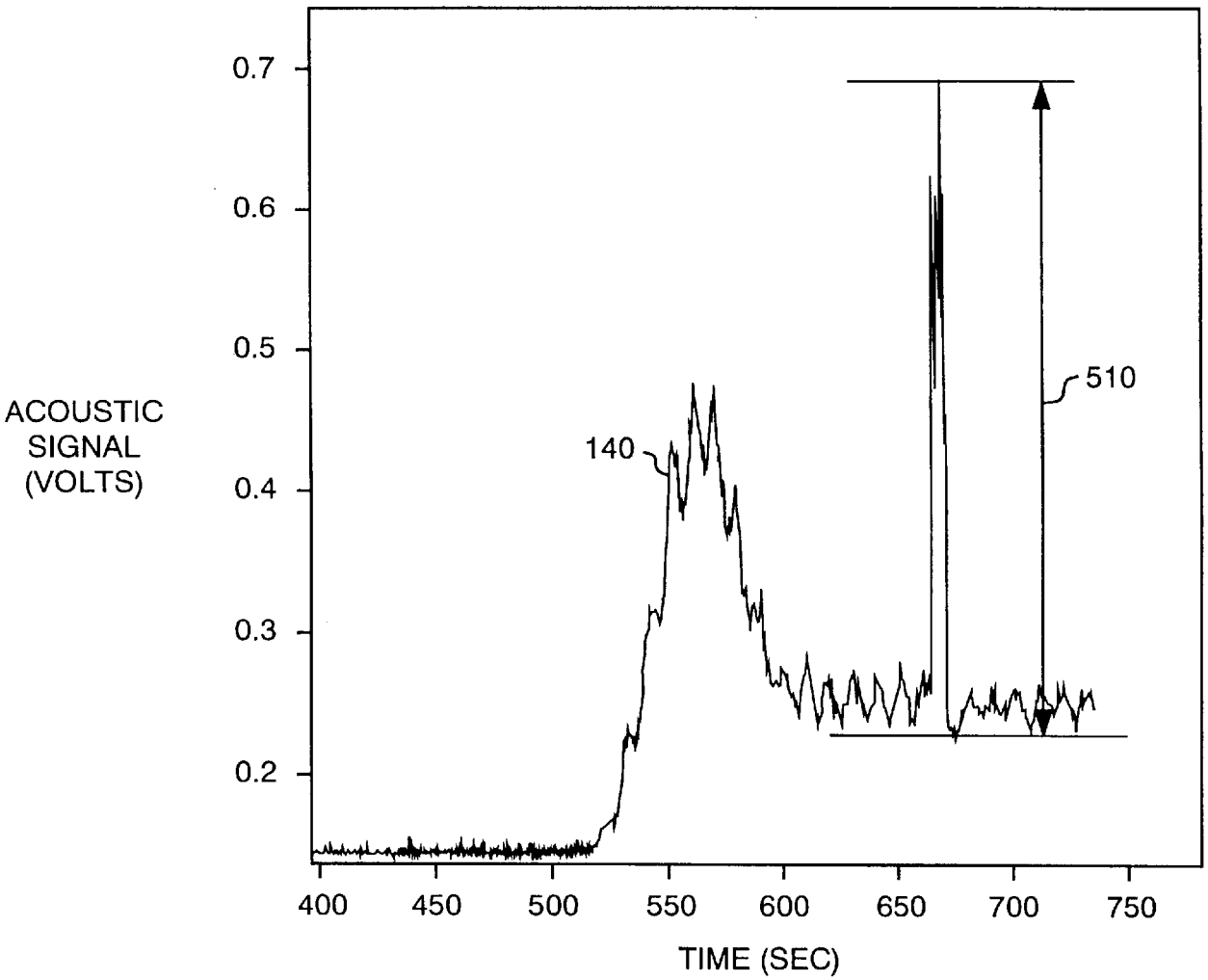
FIG. 5 is a graph of the acoustic signal before and during a boil over condition.

The boil over condition is the condition in which the liquid contents of the utensil begins to boil over the side of the utensil on the cook-top. The boil over condition generates a characteristic increase in acoustic signal 140, typically, after rolling boil state 180 has been achieved. One example graph 500 of a boil over condition is illustrated in FIG. 5, where acoustic signal 140, measured in volts, is plotted over a time interval of about 750 seconds. The boil over condition becomes evident after rolling boil state 170 has been achieved, as indicated by the high level of modulation in the amplitude of acoustic signal 140 between about 650 and about 700 seconds. By way of example and not limitation, when a boil over modulation range 510 reaches 50% of the maximum amplitude of acoustic signal 140, after rolling boil state 170 has been achieved, a boil over condition has been achieved. Action can be taken after the boil over condition has been maintained, for example, at least 50 seconds.

Figure 10:
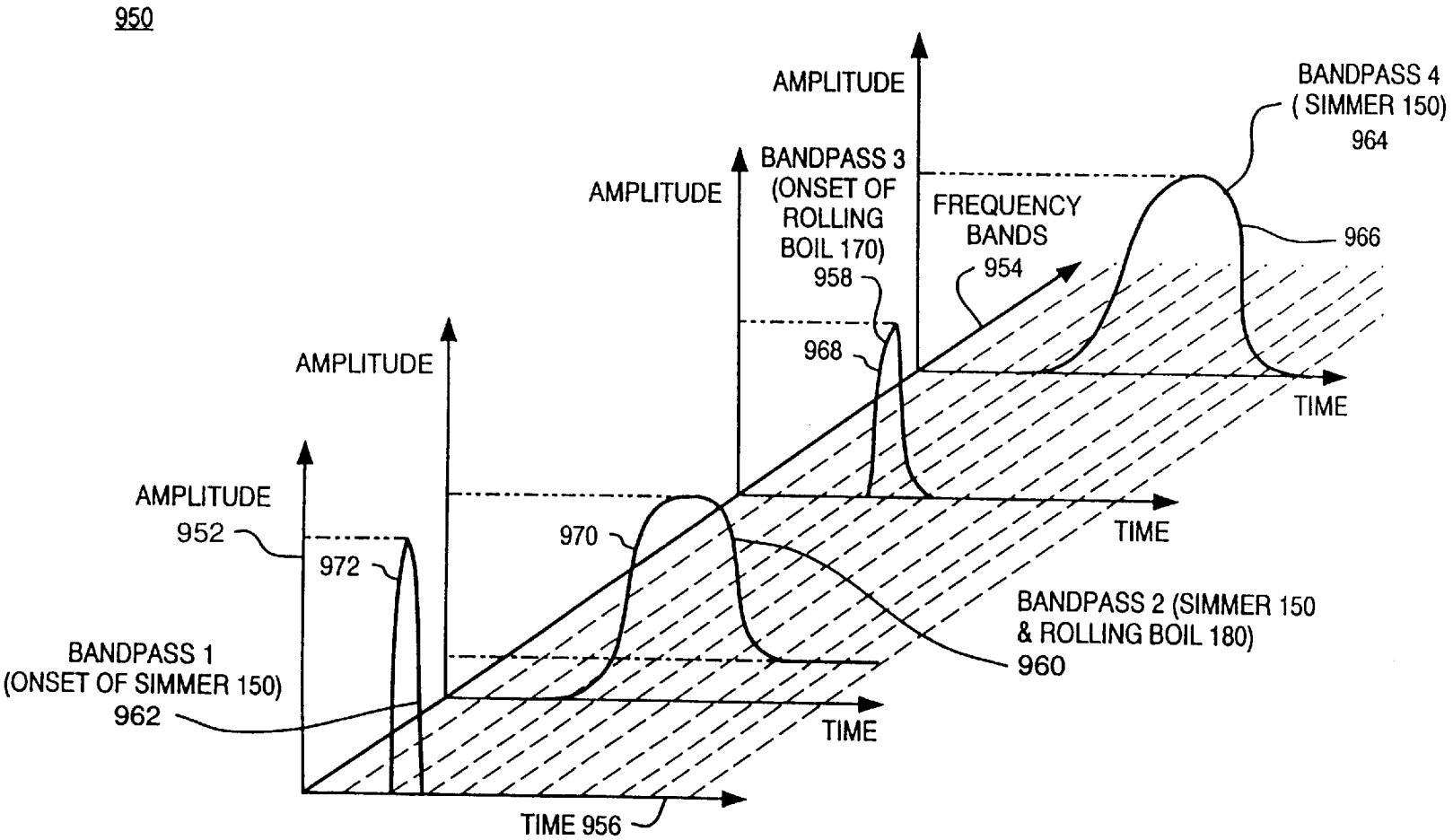
FIG. 10 is a three dimensional plot of the acoustic sensor response over time, and frequency illustrating the changes in different frequency bands of the acoustic signal over the course of the boil cycle.

In addition, more sophisticated features of the acoustic signal, such as the change in the acoustic signal frequency as the boil progresses, may also be used to detect various boil events or to distinguish between different boil events. FIG. 10 illustrates a three dimensional plot 950 of the frequency responses of filtered acoustic signal over time. The three axes over which the acoustic signal data 310 is plotted includes, an acoustic sensor amplitude 952, an acoustic sensor frequency band or range 954, and time axis 956. Four frequency bands are shown, including: bandpass 1 (962) (corresponding to the onset of simmer 150); band pass 2 (960) (corresponding to the simmer and steady-state rolling boil); band pass 3 (964) (958) (corresponding to the onset of rolling boil 170); and band pass 4 (corresponding to simmer 150). By way of example and not limitation, bandpass 1 corresponds to frequency range 200–800 Hz, bandpass 2 corresponds to frequency range 1500–2200 Hz, band pass 3 corresponds to frequency range 2200–3000 Hz, and bandpass 4 corresponds to frequency range 3200–5000 Hz. In this example, the total frequency band pass range is from about 200 Hz to about 5000 Hz. Graph 950 illustrates that each boil phase operates in a characteristic frequency band, which characteristic frequency band is detectable using the present invention, as further described below.

Figure 8:
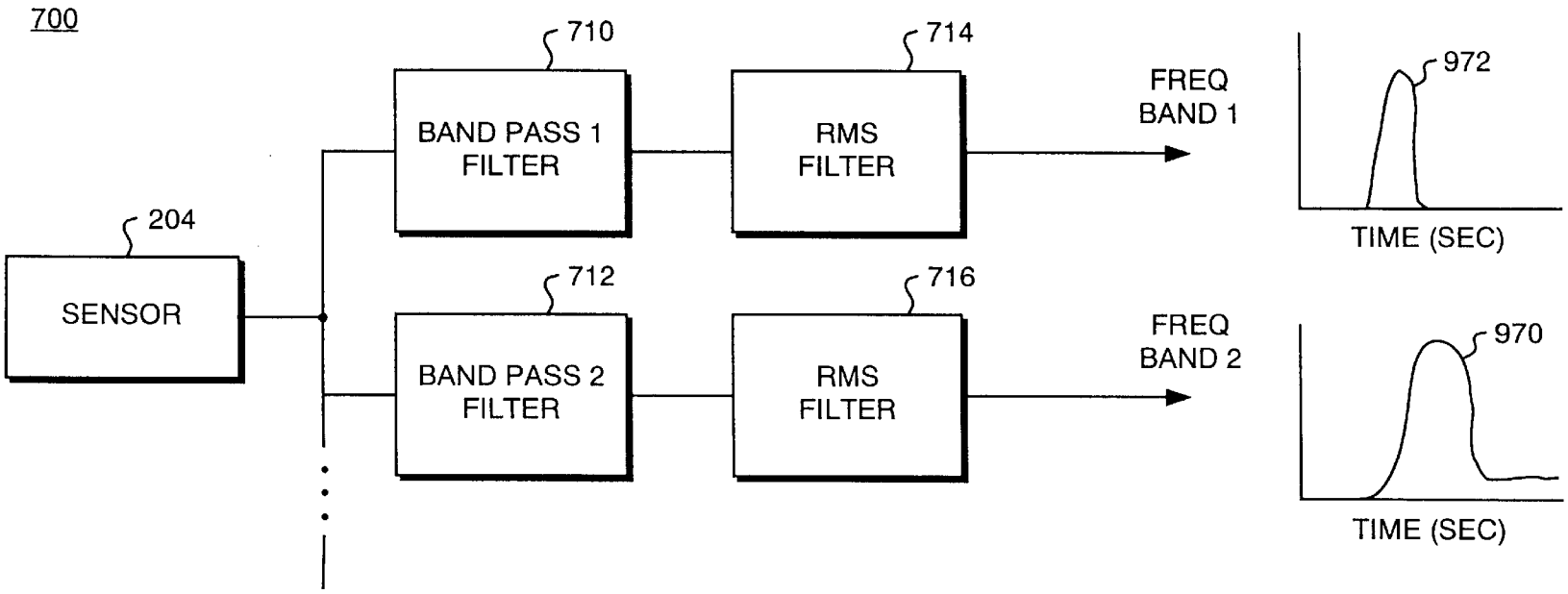
FIG. 8 is a functional block diagram of a circuit used to determine the boil state by measuring changes in different frequency bands of the acoustic signal over the course of the boil cycle.
Figure 9:
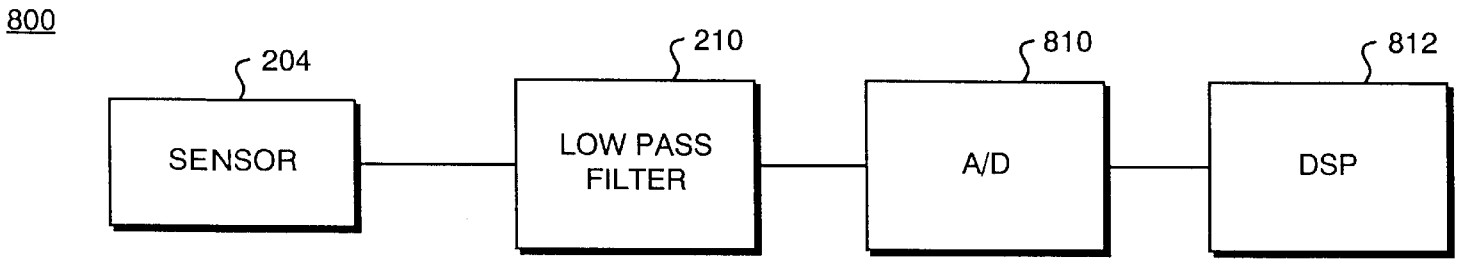
FIG. 9 is a functional block diagram of a microprocessor based circuit used to determine the boil state by measuring changes in different frequency bands of the acoustic signal over the course of the boil cycle.

Again by way of example, FIG. 8 illustrates a frequency discrimination circuit 700 (as part of acoustic sensing system 200 (FIG. 2), which comprises at least one band pass filter 710 and 712, which are configured to detect specific frequency bands (e.g. bandpass 1, bandpass 2, bandpass 3, and bandpass 4 identified above) instead of the acoustic signal 310. As each boil phase generates a characteristic frequency dependent signature, the frequency range is discriminated using circuit 700. Alternatively, a digital signal processor based frequency detection and discrimination circuit 800 may be used to detect the characteristic frequency signatures of the various boil states, as illustrated in FIG. 9. Frequency detector 800 comprises sensor 204, potentially a lowpass filter 210, an analog to digital converter (A/D) 810, and a digital signal processor (DSP) 812. DSP 812 may, conveniently, be programmed to detect the desired frequency ranges identified in band pass 1, bandpass 2, bandpass 3, and bandpass 4, previously described. Low pass filter 210 acts to filter noise from acoustic signal 140, and A/D 810 converts the acoustic signal to a digital form appropriate for DSP 812. The signal processing may include an FFT, or the like.

Generally, a box plot is used to illustrate the data sample distribution. The box has lines at the lower quartile, median, and upper quartile values. The whiskers are lines extending from each end of the box to show the extent of the rest of the data. The outliers are data with values beyond the ends of the whiskers.

Figure 11:
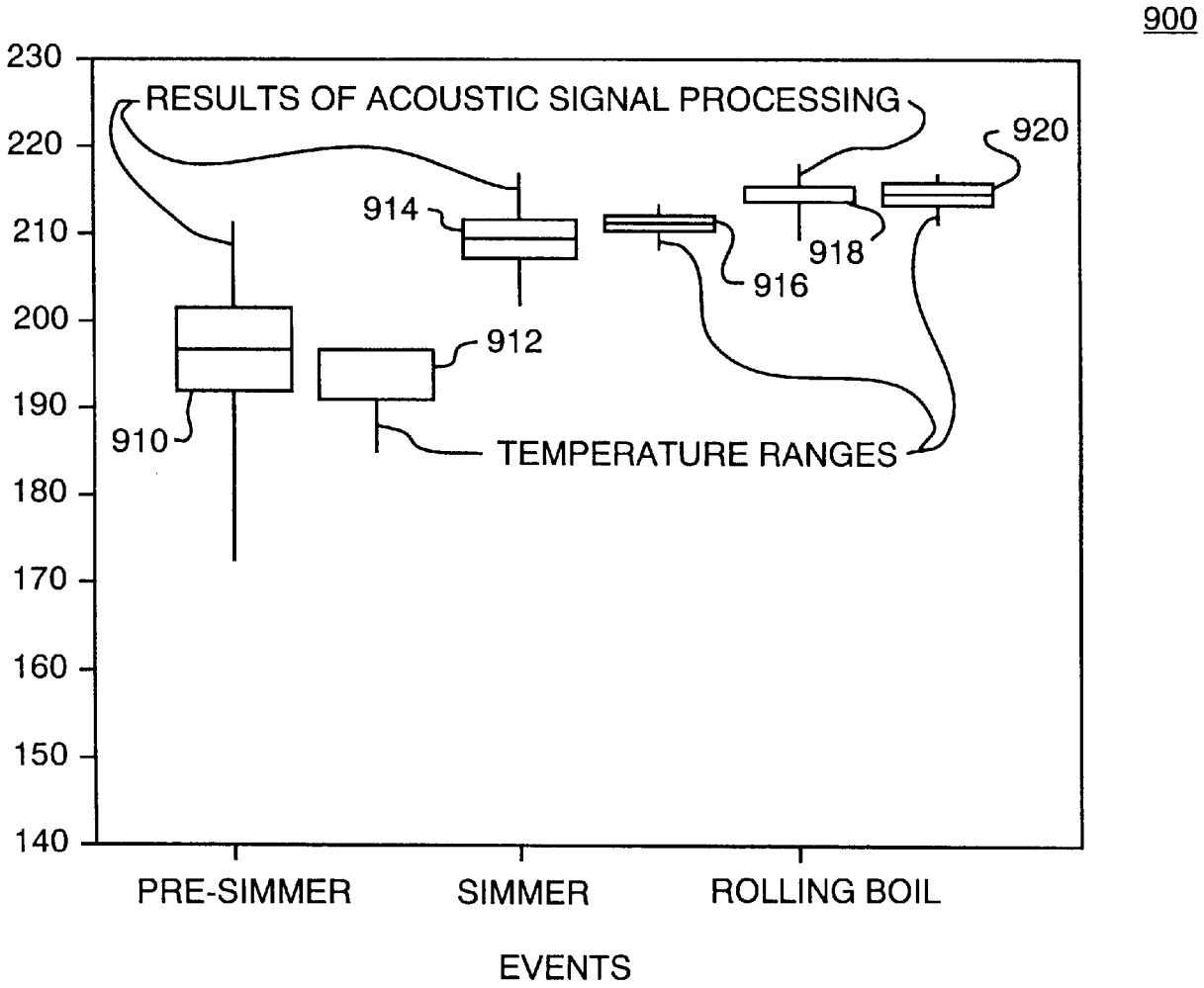
FIG. 11 is a box plot of illustrating how the acoustic features can be matched to boil states defined by temperature.

A box plot graph 900 depicting boil phases measured from several boil cycles, utilizing the present invention, is presented in FIG. 11. Graph 900 illustrates the measurement of three boil phases, including the pre-simmer phase (150), the simmer phase 160, and the rolling boil phase 180, identified during a large number of boil cycles of water, using various size cooking utensils having various amounts of water on a ceramic cook-top range as well as various disturbances. These three boil phases are identified as box 910 (pre-simmer), box 914 (simmer) and box 918 (rolling boil).

Also identified are three baseline boil phases representing the pre-simmer phase, box 912, the simmer phase, box 916, and the rolling boil phase, box 920, as identified by a professional home economist while observing similar boil cycles. The baseline boil phases are used as the standard for accurate boil detection of the present invention.

From the data plotted in graph 950, the pre-simmer, simmer, and rolling boil phases are identified using the present invention. The accuracy obtained by using only broad band passed acoustic data may be improved if frequency variation in the acoustic response is considered. Consequently, distinct frequency bands of acoustic signal 140 are utilized. These frequency bands may also be chosen to simplify the detection of boil phases, and in addition, to avoid potential erroneous indications based on acoustic phenomena not related to the boil phases.

A signal representative of the power level measurement of the energy applied to heat the liquid is used to improve the robustness of feature recognition algorithm 220 by anticipating the effects of power level changes. This includes, but is not limited to, differentiating between a reduction in acoustic energy due to boiling and that due to the heat source energy being reduced.

Figure 1:
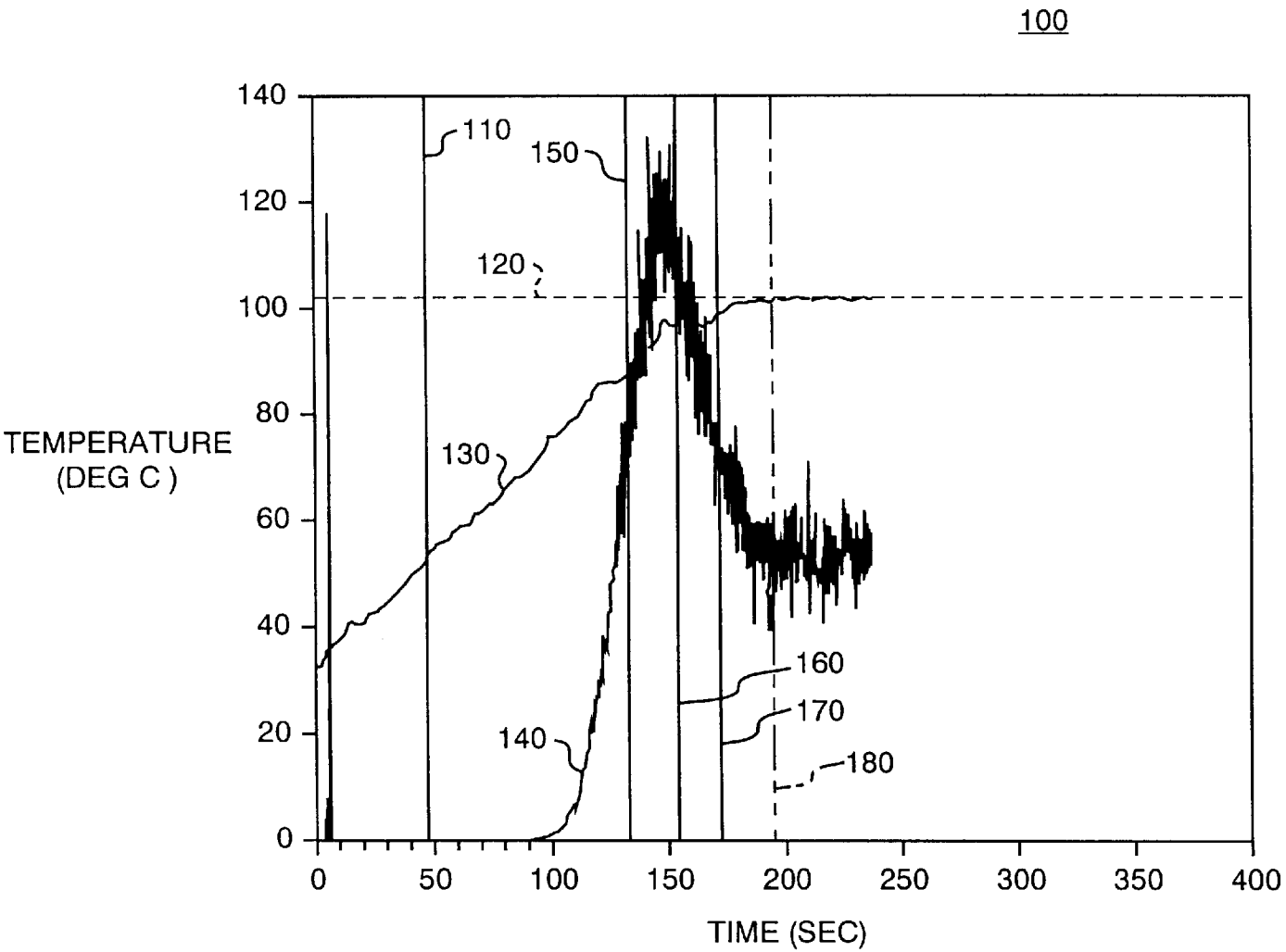
FIG. 1 is a graph plotting the characteristic response in an acoustic sensor created by boiling liquid.

The power level signal, or other signal representative of the energy applied to the liquid, is also used to identify which burner is associated with an observed boiling signal. In the case of two liquids being brought to a boil, the power level may be combined with a differential acoustic processing from multiple acoustic signals to identify the source of the observed acoustic signature 140 (FIG. 1).

The processing delay inherent in filtering and smoothing acoustic signal 140 causes a proportional delay between the occurrence of a boil phase and when the resultant feature is detected by algorithm 220 (FIG. 2). For improved response time this delay is compensated for through the use of predictive algorithms. One exemplary embodiment of predictive algorithm involves the following steps:

Step A-1. Measure the expected processing delay.

Step A-2. Tracking the change in the value of the process delay signal including one or more of its derivatives.

Step A-3. Use of the known delay to extrapolate the most recent processed signal value (for example, the first derivative signal as measured from a first derivative signal line 215, illustrated in FIG. 6), to the most likely value and state of the unprocessed signal (for example, the median signal from a median filter signal line 213). This same predictive approach can be used to vary the control strategy in anticipation of upcoming boil phases, including, but not limited to, reducing power to prevent occurrence of a boil condition.

It will be apparent to those skilled in the art that, while the invention has been illustrated and described herein in accordance with the patent statutes, modifications and changes maybe made in the disclosed embodiments without departing from the true spirit and scope of the invention. It is, therefore, to be understood that the appended claims are intended to cover all such modifications and changes as fall within the true spirit of the invention.

What is claimed is:

1. A method of determining at least one boil phase of a liquid as measured by an acoustic sensor employed to measure an acoustic signal generated by the liquid during heating, said method comprising the steps of:

smoothing the acoustic signal to eliminate excess variation and high frequency noise in the acoustic signal;

calculating at least one derivative of the smoothed acoustic signal; and determining said at least one boil phase of the liquid using a feature recognition algorithm to evaluate the smoothed acoustic signal and said at least one derivative of the smoothed acoustic signal.

2. The method as recited in claim 1, further comprising the steps of:

selecting at least one acoustic signal frequency range corresponding to said at least one boil phase of the liquid; and identifying said at least one boil phase of the liquid by analyzing the smoothed acoustic signal in the said at least one frequency range.

3. The method as recited in claim 2, wherein the step of identifying said at least one boil phase of the liquid comprises identifying said at least one boil phase selected from the group consisting of a pre-simmer phase, a simmer phase, a pre-boil phase, and a rolling boil phase.

4. The method as recited in claim 2, wherein the step of selecting said at least one acoustic signal frequency range comprises selecting said at least one acoustic signal frequency range within a frequency range from about 200 Hz to about 5000 Hz.

5. The method as recited in claim 2, wherein the step of selecting said at least one acoustic signal frequency range comprises selecting said at least one acoustic signal frequency range selected from the group of frequency ranges, consisting of, about 200 to about 800 Hz, about 1500 to about 2200 Hz, about 2200 to about 3000 Hz, and about 3200 to about 5000 Hz.

6. The method as recited in claim 1, wherein the step of smoothing the acoustic signal comprises the steps of:

filtering the acoustic signal using a low pass filter to remove high frequency noise; and median filtering the filtered acoustic signal to remove the excess variation in the filtered acoustic signal.

7. The method as recited in claim 1, wherein the step of determining said at least one boil state comprises correlating a first zero slope point of a first of said at least one derivative of the smoothed acoustic signal and a positive going inflection point of smoothed acoustic signal to a pre-simmer phase.

8. The method as recited in claim 1, wherein the step of determining said at least one boil state comprises correlating a first zero slope point of the smoothed acoustic signal and a zero crossing point of a first of said at least one derivative of the smoothed acoustic signal to a simmer phase.

9. The method as recited in claim 1, wherein the step of determining said at least one boil state comprises correlating a second zero slope point of a first of said at least one derivative of the smoothed acoustic signal and a negative going inflection point of the smoothed acoustic signal to a pre-boil phase.

10. The method as recited in claim 1, wherein the step of determining said at least one boil state comprises determining a boil point corresponding to a first of said at least one derivatives of the smoothed acoustic signal reaching a pre-determined threshold after a pre-boil phase has been identified.

11. The method as recited in claim 1, further comprising the step of compensating said at least one derivative for timing delays introduced during said step of calculating said at least one derivative of the smoothed acoustic signal.

12. The method as recited in claim 1, further comprising the step of identifying a boil dry condition by analyzing the smoothed acoustic signal and said at least one derivative of the smoothed acoustic signal.

13. The method as recited in claim 12, wherein said step of identifying said boil dry condition comprises determining at least about a 50 percent reduction in an amplitude of the smoothed acoustic signal after determination of a rolling boil phase of said at least one boil state of the liquid wherein said at least about a 50 percent reduction occurs for a duration of at least about 50 seconds.

14. The method as recited in claim 1, further comprising the step of identifying a boil over condition by analyzing the smoothed acoustic signal and said at least one derivative of the smoothed acoustic signal.

15. The method as recited in claim 14, wherein said step of identifying said boil over condition comprises determining at least about a 50 percent increase in an amplitude of the smoothed acoustic signal after determination of a rolling boil phase of said at least one boil state of the liquid.

16. The method as recited in claim 1, further comprising the step of compensating the smoothed acoustic signal for timing delays introduced during said step of smoothing.

17. A method of determining at least one boil phase of a liquid as measured by an acoustic sensor utilized to measure an acoustic signal generated by a liquid during heating, said method comprising the steps of:

filtering the acoustic signal to remove excess variation and high frequency noise from the acoustic signal;

selecting at least one acoustic signal frequency range corresponding to said at least one boil phase of the liquid; and identifying said at least one boil phase of the liquid by analyzing the filtered acoustic signal in the selected at least one frequency range.

18. The method as recited in claim 17, wherein the step of identifying said at least one boil phase comprises identifying said at least one boil phase selected from the group consisting of a pre-simmer phase, a simmer phase, a pre-boil phase, and a rolling boil phase.

19. The method as recited in claim 17, wherein the step of selecting said at least one acoustic signal frequency range comprises selecting a frequency range from about 200 Hz to about 5000 Hz.

20. The method as recited in claim 17, wherein the step of selecting said at least one acoustic signal frequency range comprises selecting a band frequency range selected from the group consisting of, about 200 to about 800 Hz, about 1500 to about 2200 Hz, about 2200 to about 3000 Hz, and about 3200 to about 5000 Hz.

21. The method as recited in claim 17, wherein the step of filtering the acoustic signal comprises using a median filter to remove excess variation of the acoustic signal and using a low pass filter to remove high frequency noise from the acoustic signal.

22. An apparatus for determining at least one boil phase of a liquid as measured by an acoustic sensor utilized to measure an acoustic signal generated by a liquid during heating, said apparatus comprising:

at least one filter connected to the acoustic sensor for receiving and filtering the acoustic signal to eliminate excess variation and high frequency noise from the acoustic signal;

a signal processor connected to said at least one filter for calculating at least one derivative of the filtered acoustic signal; and a microprocessor connected to said signal processor and employing a feature recognition algorithm to evaluate the filtered acoustic signal and said at least one derivative of the filtered acoustic signal to determine said at least one boil phase of the liquid.

23. The apparatus as recited in claim 22, wherein said at least one boil phase is selected from the group consisting of a pre-simmer phase, a simmer phase, a pre-boil phase, and a rolling boil phase.

24. The apparatus as recited in claim 22, wherein said microprocessor uses said feature recognition algorithm to evaluate the filtered acoustic signal to identify a boil over condition.

25. The apparatus as recited in claim 22, wherein said microprocessor uses said feature recognition algorithm to evaluate the filtered acoustic signal to identify a boil dry condition.

26. The apparatus as recited in claim 22 further comprising a frequency filter connected between the acoustic filter and said at least one filter for filtering the acoustic signal into at least one acoustic signal frequency range corresponding to said at least one boil phase of the liquid.

27. An apparatus for determining at least one boil phase of a liquid as measured by an acoustic sensor utilized to measure an acoustic signal generated by a liquid during heating, said apparatus comprising:

at least one filter connected to the acoustic sensor for receiving and filtering the acoustic signal to eliminate excess variation and high frequency noise from the acoustic signal;

a frequency filter connected to said at least one filter, said frequency filter filtering the acoustic signal into at least one frequency range corresponding to said at least one boil phase of the liquid; and a microprocessor connected to said frequency filter and identifying said at least one boil phase of said liquid by analyzing said acoustic signal in said at least one frequency range.

* * * * *